US008770716B2

(12) United States Patent
Aoki

(10) Patent No.: US 8,770,716 B2
(45) Date of Patent: Jul. 8, 2014

(54) IMAGE FORMING APPARATUS

(75) Inventor: Hideo Aoki, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 104 days.

(21) Appl. No.: 12/490,648

(22) Filed: Jun. 24, 2009

(65) Prior Publication Data

US 2009/0256884 A1 Oct. 15, 2009

(30) Foreign Application Priority Data

Jul. 2, 2008 (JP) ..... 2008-173291

(51) Int. Cl.
*B41J 2/165* (2006.01)

(52) U.S. Cl.
USPC ..... 347/36

(58) Field of Classification Search
None
See application file for complete search history.

(56) References Cited

U.S. PATENT DOCUMENTS

| | | | | |
|---|---|---|---|---|
| 5,953,031 | A * | 9/1999 | Omata et al. | 347/86 |
| 7,404,619 | B2 * | 7/2008 | Tamai et al. | 347/36 |
| 7,419,241 | B2 * | 9/2008 | Kawashima et al. | 347/36 |
| 7,510,257 | B2 * | 3/2009 | Jung et al. | 347/19 |
| 2005/0212850 | A1 * | 9/2005 | Kimura | 347/36 |
| 2006/0244799 | A1 * | 11/2006 | Sasa et al. | 347/89 |
| 2007/0052750 | A1 * | 3/2007 | Tokuno et al. | 347/30 |
| 2007/0229627 | A1 * | 10/2007 | Ogawa | 347/86 |

FOREIGN PATENT DOCUMENTS

| | | |
|---|---|---|
| JP | 2003-246046 | 9/2003 |
| JP | 2003-266747 | 9/2003 |
| JP | 2005-254636 | 9/2005 |
| JP | 2006-272874 | 10/2006 |
| JP | 2006-306042 | 11/2006 |
| JP | 2007-21758 | 2/2007 |
| JP | 2007-62236 | 3/2007 |

OTHER PUBLICATIONS

Jul. 3, 2012 communication from the Japanese Patent Office in connection with Japanese patent application No. 2008-173291.

* cited by examiner

*Primary Examiner* — Alejandro Valencia
(74) *Attorney, Agent, or Firm* — Cooper & Dunham LLP

(57) ABSTRACT

An image forming apparatus includes a recording head to eject ink droplets through a nozzle onto a recording medium, a replaceable ink cartridge to contain ink to be supplied to the recording head, a replaceable waste-ink tank to store waste ink ejected from the recording head, a cartridge mounting portion provided on a front side of the image forming apparatus and configured to accommodate the ink cartridge, including a first opening through which the ink cartridge is inserted, a tank mounting portion provided on the front side of the image forming apparatus, adjacent to the cartridge mounting portion, and configured to accommodate the waste-ink tank and to include a second opening through which the waste-ink tank is inserted, and an openably closable cartridge cover disposed on the front side of the image forming apparatus, configured to cover both the first opening and the second opening.

19 Claims, 17 Drawing Sheets

IMAGE FORMING APPARATUS

CROSS-REFERENCE TO RELATED APPLICATIONS

This patent specification is based on and claims priority from Japanese Patent Application No. 2008-173291, filed on Jul. 2, 2008 in the Japan Patent Office, the entire contents of which are hereby incorporated by reference herein.

BACKGROUND

1. Technical Field

This disclosure generally relates to an image forming apparatus, and more particularly, to an image forming apparatus including a recording head to eject ink droplets onto sheets of recording media.

2. Discussion of the Background Art

As image forming apparatuses, such as printers, facsimile machines, plotters, or multifunction machines including at least two of these functions, liquid-ejecting image forming apparatuses such as inkjet recording devices that use a recording head for ejecting ink droplets are known.

There are two types of liquid-ejecting image forming apparatuses. Serial-type image forming apparatuses form images using a recording head that ejects ink droplets onto a recording medium while moving in a main scanning direction. By contrast, line-type image forming apparatuses form images using a recording head that remains stationary while ejecting ink droplets.

In either case, the liquid-ejecting image forming apparatuses form images by ejecting the ink droplets from the recording head onto a sheet of recording media while the sheet is being transported.

In such liquid-ejecting image forming apparatuses, a need has arisen to increase image formation throughput, that is, image formation speed. One way to achieve that aim is to reduce the replacement time required to replace ink cartridges.

Accordingly, a known liquid-ejecting image forming apparatus uses a large-capacity ink cartridge that is replaceably attached to the image forming apparatus. Ink is supplied from the large-capacity ink cartridge via a supply tube to a sub-tank, which is also called a head tank, provided in an upper portion of the main body.

Although such an arrangement has advantages, it also has several drawbacks. For example, because the recording head ejects ink from nozzles onto the sheet, over time the ink tends to thicken or even solidify as solvent evaporates from the ink through the nozzle. In addition, dust tends to adhere to the nozzle, and air can get into the nozzle, all of which can cause ejection failure, resulting in the production of substandard images.

Therefore, liquid-ejecting image forming apparatuses typically include a maintenance unit or cleaning unit that removes waste ink from the recording head to maintain good printing performance of the recording head. The waste ink removed from the recording head is stored in a waste-ink tank or waste-ink container which is replaceable in order to extend the operational life of the image forming apparatus.

When the main tank and the waste-ink tank are replaced, the liquid-ejecting image forming apparatus must be deactivated. However, in such known liquid-ejecting image forming apparatuses, because separate detectors are used to detect removal of the ink cartridge and that of the waste-ink tank, its configuration is relatively complicated, and accordingly its cost is relatively high.

In view of the foregoing, there is a need to detect replacement of the ink cartridge as well as that of the waste-ink tank using a simple configuration.

BRIEF SUMMARY

In an aspect of this disclosure, there is provided an image forming apparatus that includes a recording head configured to eject ink droplets through a nozzle onto a recoding medium, a replaceable ink cartridge configured to contain ink to be supplied to the recording head, a replaceable waste-ink tank configured to store waste ink ejected from the recording head, a cartridge mounting portion configured to accommodate the ink cartridge, including a first opening, a tank mounting portion provided adjacent to the cartridge mounting portion, configured to accommodate the waste-ink tank and to include a second opening, and an openably closable cartridge cover configured to cover both the first opening and the second opening. The cartridge mounting portion, the tank mounting portion, and the cartridge cover are provided on a front side of the image forming apparatus. The ink cartridge and the waste-ink tank are respectively inserted from the front side of the image forming apparatus through the first opening and the second opening to the cartridge mounting portion and the tank mounting portion.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
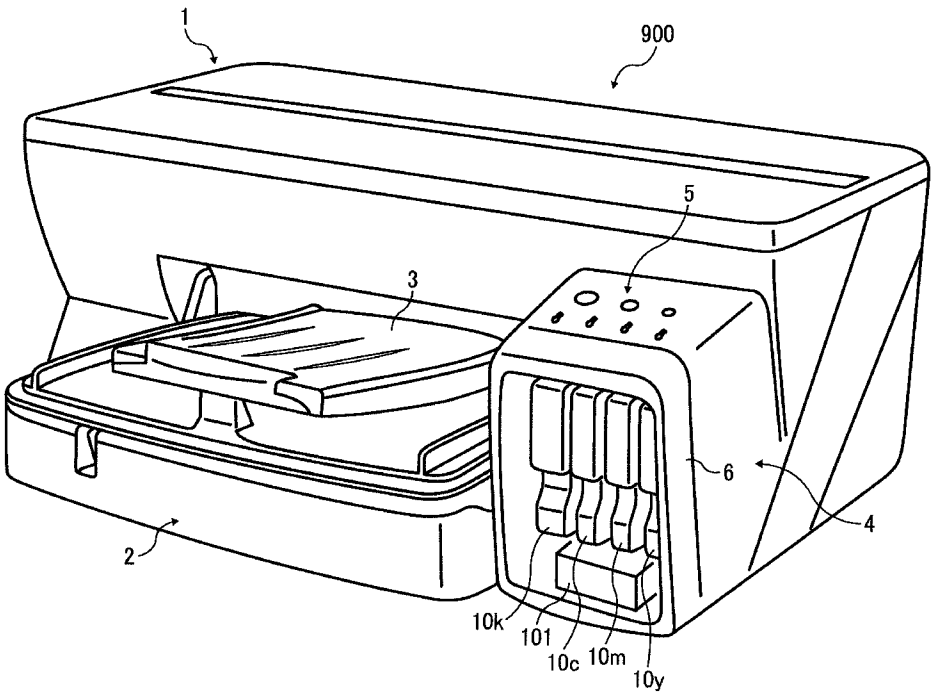
FIG. 1 is a perspective diagram illustrating an exterior of a liquid-ejecting image forming apparatus according to one illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that, in the present application, "liquid-ejecting image forming apparatus" means the device that ejects the ink to a recording medium, such as paper, thread, fiber, textile, metal, plastic, glass, ceramic, etc., so as to form images thereon, and "image forming" includes both forming on the recording medium an image including a pattern, etc., that has no commonly understood meaning as well as image including a letter and/or an illustration that does have a given meaning. Further, "ink" is not limited to only the materials generally called "ink" but also used as a generic term for the liquid, such as recording-liquid, fixing liquid, other liquid, etc., that can form images.

Moreover, "sheet" includes not only paper but also any materials to which ink can adhere, such as an overhead projector (OHP) sheet, textile, etc., and is used as a generic term for all types of recording media, recording paper, a recording sheet, etc.

Figure 2:
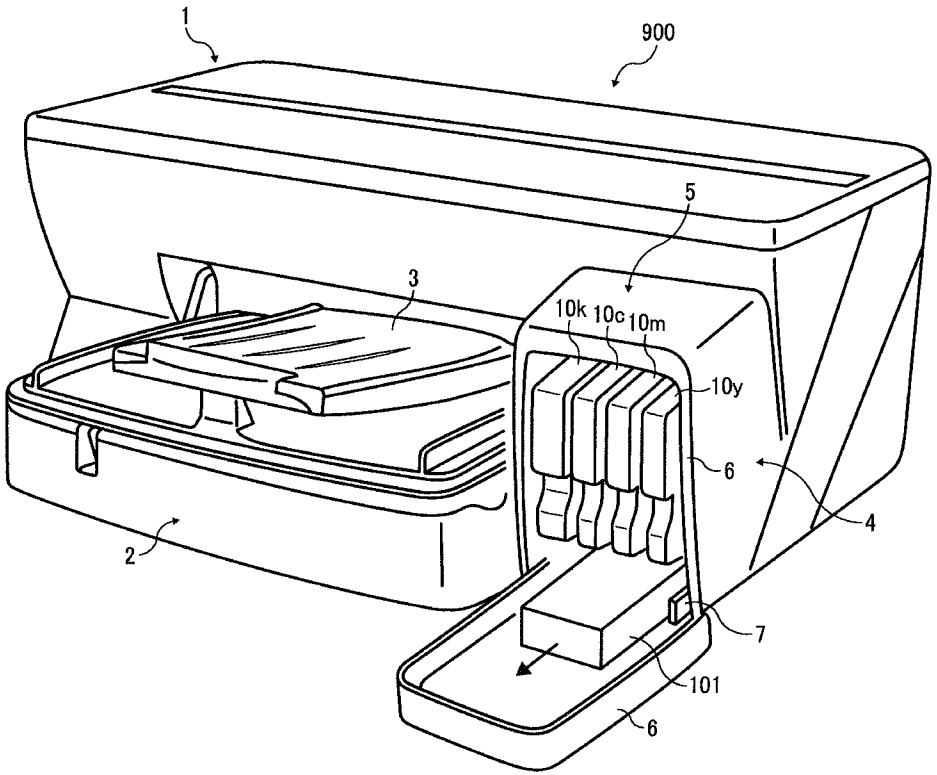
FIG. 2 is an external perspective diagram illustrating the image forming apparatus when a cartridge cover is open.

Referring now to the drawings, wherein like reference numerals designate identical or corresponding parts throughout the several views thereof, and particularly to FIGS. 1 and 2, a liquid-ejecting image forming apparatus according to an illustrative embodiment of the present invention is described.

FIG. 1 is a perspective diagram illustrating the liquid-ejecting image forming apparatus 900 viewed from a front side.

Referring to FIG. 1, a liquid-ejecting image forming apparatus (hereinafter simply "image forming apparatus") 900 that in the present embodiment is serial type and includes a main body 1, a sheet feed tray 2 attached to the main body 1, and a discharge tray 3 detachably attached to the main body 1. Sheets of recording media to be fed to the main body 1 are stacked on the sheet feed tray 2, and the sheets are discharged onto the discharge tray 3 after images are formed thereon.

The image forming apparatus 900 further includes a cartridge/tank mount 4 disposed in an edge portion, on the side of the sheet feed tray 2 and the discharge tray 3, on the front side of the main body 1. Within a recessed portion of the cartridge/tank mount 4, ink cartridges 10*k*, 10*c*, 10*m*, and 10*y*; and a replaceable second waste-ink tank 101 can be detachably attached. Additionally, an operation and display unit 5 is provided on an upper surface of the cartridge/tank mount 4, and an openably closable cover 6 for ink cartridge replacement is provided on a front side of the cartridge/tank mount 4.

The image forming apparatus 900 further includes a controller 90 (shown in FIG. 15) to control various operations thereof.

The ink cartridges 10*k*, 10*c*, 10*m*, and 10*y* contain different color recording liquids (inks), respectively. For example, the ink cartridges 10*k*, 10*c*, 10*m*, and 10*y* contain black, cyan, magenta, and yellow inks. It is to be noted that reference characters k, c, m, and y represent black, cyan, magenta, and yellow, respectively, and may be omitted in the description below when color discrimination is not required.

Next, a mechanism of the liquid-ejecting image forming apparatus 900 is described below with reference to FIGS. 3 and 4, which are respectively a side view illustrating a schematic configuration of the image forming apparatus 900 and a plan view illustrating main components thereof.

Figure 4:
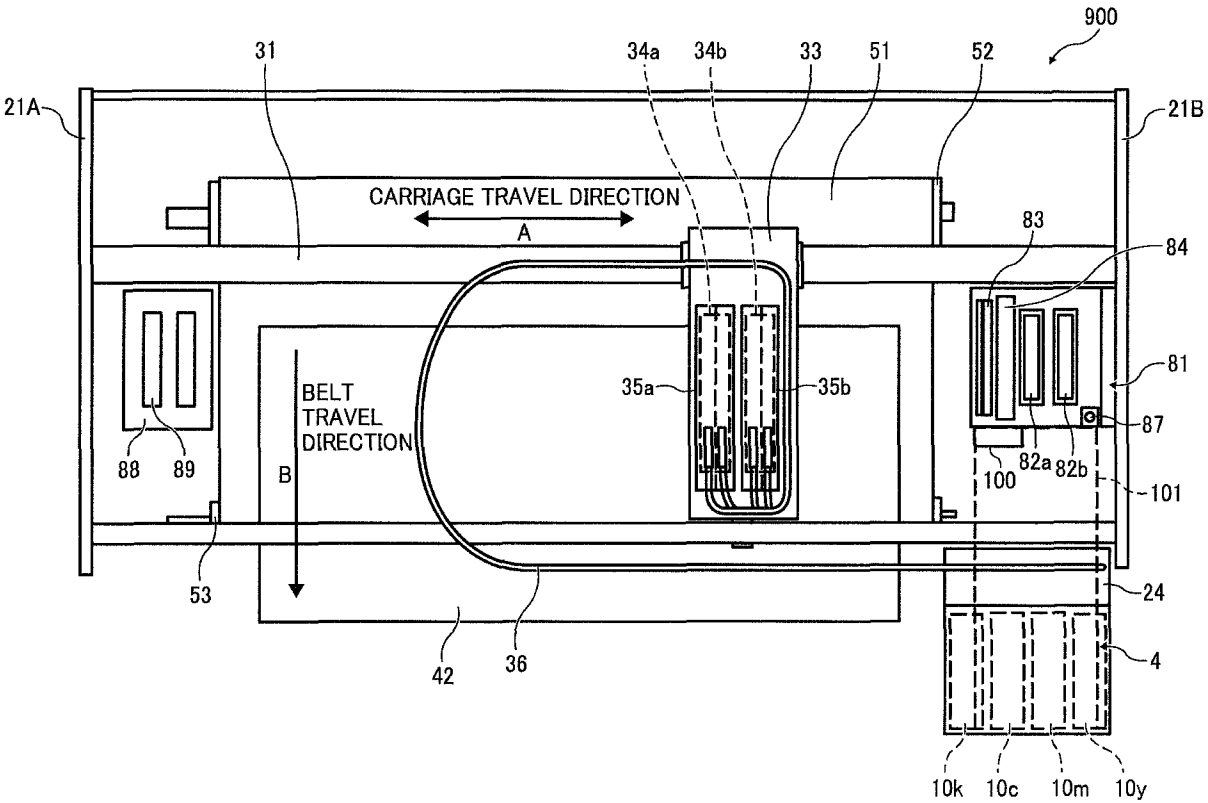
FIG. 4 is a plan view illustrating main components of the image forming apparatus.

The main body 1 includes right and left side plates 21A and 21B, main and sub guide rods 31 and 32 lying between the side plates 21A and 21B, and a carriage 33 held by the main and sub guide rods 31 and 32 slidably in a main scanning direction or carriage travel direction, which is indicated by arrow A shown in FIG. 4. The carriage 33 is moved in the main scanning direction by a main scanning motor, not shown, via a timing belt, not shown.

In the carriage 33, recording heads 34*a* and 34*b* that eject the ink are mounted. In the present embodiment, each of the recording heads 34*a* and 34*b* includes two nozzle lines each including multiple nozzles. The recording heads 34*a* and 34*b* are arranged with their ink ejection surface (nozzle surface) down and their nozzles lines in a sub-scanning direction indicated by arrow B shown in FIG. 4, which is perpendicular to the main scanning direction indicated by arrow A.

The nozzle lines of the recording heads 34*a* are respectively for the black ink and for the cyan ink, and the nozzle lines of the recording 34*b* are respectively for the magenta ink and the yellow ink.

The carriage 33 further includes sub-tanks 35*a* and 35*b* that supply the respective color inks to the recording heads 34*a* and 34*b* in accordance with the color of the ink ejected from the respective nozzle lines. A supply pump unit 24 supplies the respective color inks to the sub-tanks 35*a* and 35*b* from the ink cartridges 10 that are detachably attached to the cartridge mount 4 through respective supply tubes 36.

It is to be noted that hereinafter reference character suffixes "a" and "b" may be omitted when it is not necessary to discriminate between the components, such as the sub-tanks 35*a* and 35*b*, each indicated by an identical reference numeral accompanied by the reference character suffix a or b.

Figure 3:
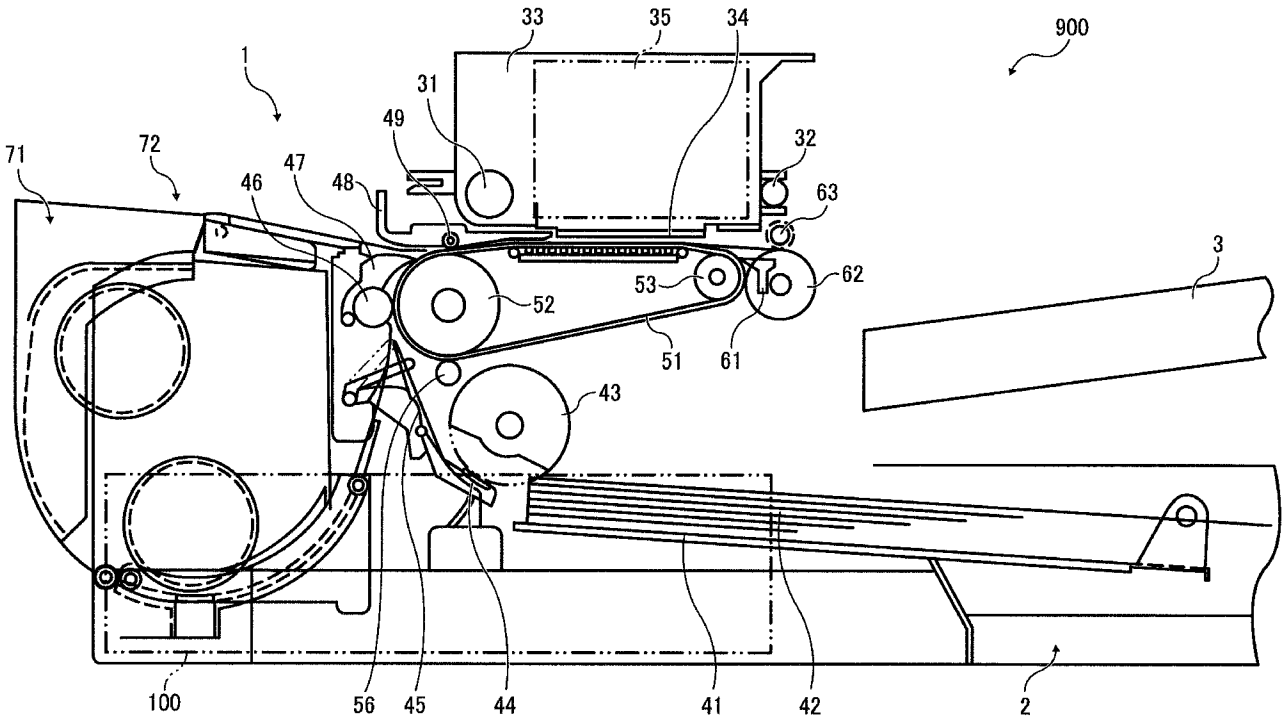
FIG. 3 is a schematic side view illustrating an interior of the image forming apparatus.

As shown in FIG. 3, the sheet feed tray 2 is provided with a loading part (pressure plate) 41 on which multiple sheets 42 can be stacked. The image forming apparatus 900 further includes a semicircular feed roller 43 and a separation pad 44 facing the feed roller 43, which form a sheet feed portion. The feed roller 43 separates only one sheet 42 from the multiple sheets 42 stacked on the loading part 41 to feed the sheet 42 to the main body 1. The separation pad 44 is formed with a material whose frictional coefficient is relatively large and is pressed toward the feed roller 43.

Further, a guide 45, a roller 46, a transport guide 47, and a pressing member 48 provided with an edge pressure roller 49 are provided to guide the sheet 42 fed from the sheet feed portion to beneath the recording heads 34. Then, the sheet 42 electrostatically adheres to an endless transport belt 51 disposed facing the ink ejection surface of the carriage 33 and is transported thereby.

The transport belt 51 is wound round a transport roller 52 and a tension roller 53 and rotatable in the sub-scanning direction indicated by arrow B shown in FIG. 4, which is hereinafter also referred to as "belt travel direction". Additionally, a charging roller 56 is disposed to contact an outer circumferential surface of the transport belt 51 to electrically charge the surface of the transport belt 51. The charging roller 56 rotates as the transport belt 51 rotates. The transport belt 51 can rotate both in the belt travel direction indicated by arrow B shown in FIG. 4 and in the opposite direction as the transport roller 52 is rotated by a sub-scanning motor, not shown, via a timing belt, not shown.

A separation pawl 61, a discharge roller 62, and a discharge spur 63 are provided downstream from the carriage 33 in the belt travel direction indicated by arrow B shown in FIG. 4 and form a discharge portion to discharge the sheet 42 on which an image is formed by the carriages 34 to the discharge tray 3 disposed beneath the discharge roller 62. The separation pawl 61 separates the sheet 42 from the transport belt 51.

On a back side of the main body 1, a duplex unit 71 is detachably attached. After an image is formed on a first side (front side) of the sheet 42, the sheet 42 is transported in reverse by the reverse rotation of the transport belt 51 to the duplex unit 71, reversed therein, and again forwarded to between the roller 46 and the transport belt 51 so that an image can be formed on a second side (back side) of the sheet 42. A manual feed tray 72 is provided on an upper surface of the duplex unit 71.

Additionally, as shown in FIG. 4, a maintenance unit or cleaning unit 81 is provided in a non-image area in the edge portion in the main scanning direction indicated by arrow A. The maintenance unit 81 includes caps 82*a* and 82*b* that respectively seal the nozzle surfaces of the recording heads 34*a* and 34*b*, a wiper (wiper blade) 83 to wipe the nozzle surfaces, a dummy ejection receiver 84, and a carriage lock 87 to lock the carriage 33. When the viscosity of the ink increases, dummy ejection, which does not contribute to image formation, is performed to discharge such waste ink, and the dummy ejection receiver 84 receives the waste ink thus discharged.

To store the waste ink received by the dummy ejection receiver 84 as well as the waste ink removed by the wiper 83, a non-replaceable first waste-ink tank 100 is provided beneath the maintenance unit 81 in addition to the second waste-ink tank 101 that is disposed beneath the ink cartridges 10. The second waste-ink tank 101 is replaceable from the front side of the main body 1.

In a non-image area in the other edge portion in the main scanning direction indicated by arrow A, another dummy ejection receiver 88 is provided. The dummy ejection receiver 88 includes an opening 89 extending in the direction of the nozzle lines of the recording heads 34.

In the image forming apparatus 900 described above, the sheets 42 on the sheet feed tray 2 are fed one by one substantially vertically by the feed roller 43 and then guided by the guide 45 to between the transport belt 51 and the roller 46. The transport guide 47 guides a leading edge of the sheet 42, the edge pressure roller 49 presses the sheet P against the transport belt 51, and then the direction in which the sheet P is transported is changed by about 90 degrees.

At that time, the charging roller 56 receives an alternating voltage, which alternates between positive voltage and negative voltage, and accordingly alternating charge voltage pattern is formed on the transport belt 51. In other words, positively-charged portions and negatively-charged portions both having a given length alternate on the transport belt 51 in the sub-scanning direction, in which the transport belt 51 travels. When the sheet 42 is fed to the transport belt 51 having the alternate positively-charged portions and negatively-charged portions, the sheet 42 electrostatically adheres to the transport belt 51 and is transported in the sub-scanning direction as the transport belt 51 rotates.

The recording heads 34 are driven to eject ink droplets according to image signals onto the sheet 42 that remain motionless while the carriage 33 moves, and thus one line is recorded on the sheet 42, which after the sheet 42 is transported for a given distance, and then a subsequent line is recorded on the sheet 42. When the controller 90 (shown in FIG. 15) receives a recording complete signal or a signal indicating that a trailing edge of the sheet 42 has reached a recording area, recording in completed, and then the sheet 42 is discharged to the discharge tray 3.

As maintenance work (cleaning) of the nozzles of the recording heads 34, the carriage 33 is moved to a home position to face the maintenance unit 81. In the cleaning, the nozzles are sealed with the cap 82*a* and waste ink is drawn out from the nozzles, wiping of the nozzle surfaces by the wiper 83, and/or dummy ejection is performed, thus restoring a state of the recording heads 34 to secure reliable image formation.

Figure 5:
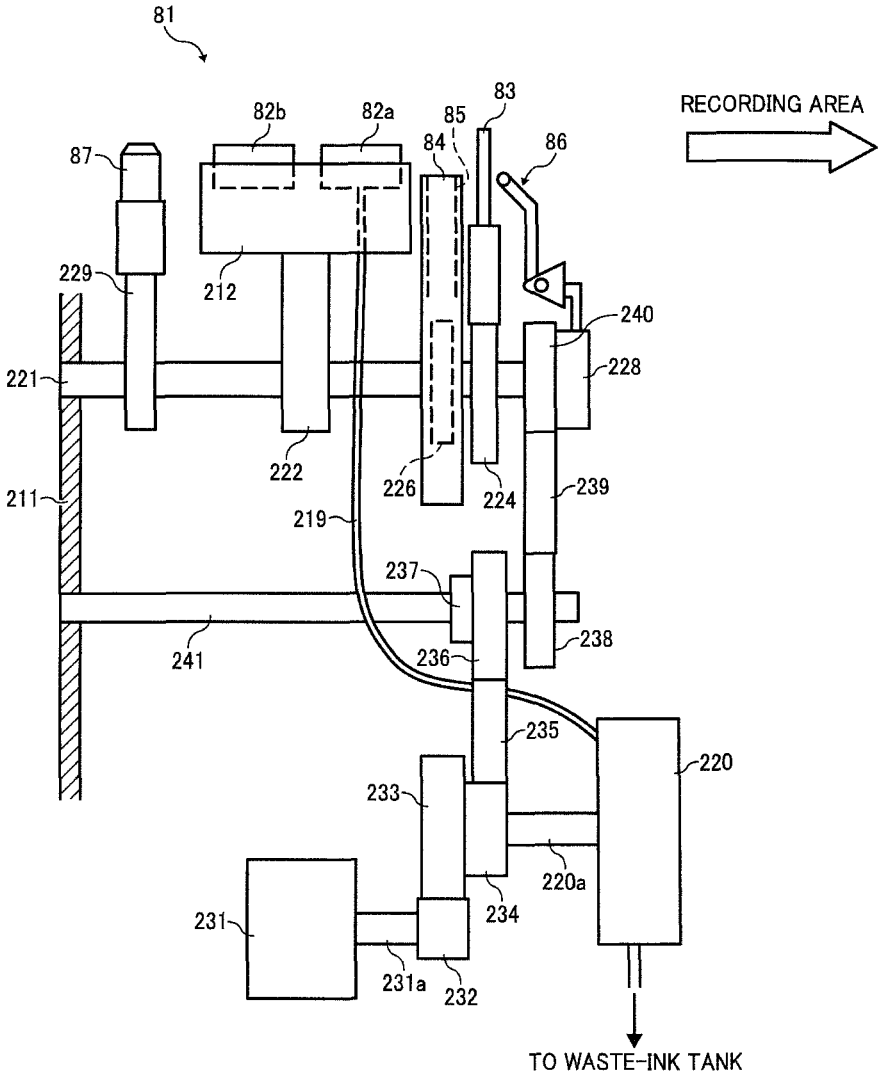
FIG. 5 is a schematic illustration of a maintenance unit included in image forming apparatus.
Figure 6:
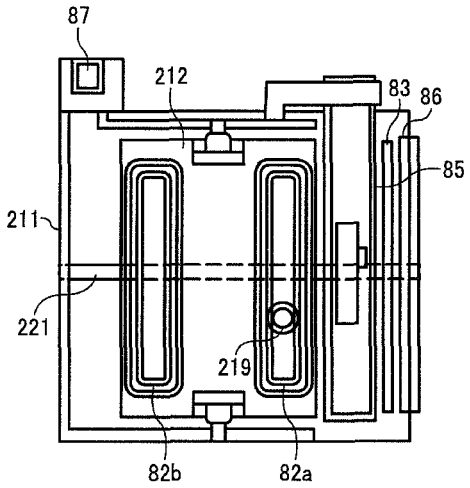
FIG. 6 is a plan view illustrating main components of the maintenance unit.

Next, the maintenance unit 81 is described in further detail below with reference to FIGS. 5 and 6. FIG. 5 is a schematic illustration of the maintenance unit 81, and FIG. 6 is a plan view illustrating main components thereof.

In the maintenance unit 81, a frame 211 indirectly supports a cap holder 212 holding the caps 82, the wiper 83 including an elastic member, and a first wiper cleaner 86 each of which is movable in a vertical direction.

Each cap 82 is shaped like a box and includes an opening provided on a side facing the nozzle surface of the recording head 34. An outer surface of the opening is equipped with an elastic member that closely contacts the nozzle surface, and thus the nozzles can be sealed or capped. Each cap 82 includes porous spongy suction member, not shown, whose capillary attraction can distribute the waste ink uniformly in the cap 82. Additionally, when a suction pump 220 sucks the ink from the cap 82*a*, the capillary attraction can transmit negative pressure caused by the sucking across the entire cap 82*a*.

The dummy ejection receiver 84 is cylindrical and is disposed between the wiper 83 and the cap 82*a* used as a sucking cap. A second wiper cleaner 85 is provided in an upper edge portion of the dummy ejection receiver 84, on the side close to the wiper 83. The second wiper cleaner 85 scrapes off the ink adhering to the wiper 83. When the wiper 83 is cleaned, the wiper 83 is lowered while the first wiper cleaner 86 presses the wiper 83 against the second wiper cleaner 85, and thus the ink is scraped off the wiper 83 to the dummy ejection receiver 84.

The suction pump 220 is connected via a flexible tube 219 to the cap 82*a* that is closer to the recording area, and thus the cap 82*a* servers as the suction cap as well as a moisturizing cap. By contrast, the cap 82*b* serves only as a moisturizing cap. Therefore, when the recording heads 34 are cleaned, the recording head 34*a* or 34*b* that is to be cleaned is selectively moved to a position to be capped by the cap 82*a*. The waste ink sucked from the nozzles using the cap 82 is stored in the second waste-ink tank 101.

By pressuring the tube 219 with multiple pressure members, not shown, and by moving the tube 219, the suction pump 220 generates suction force therein.

Although the tube 219 can be a silicone tube, it is preferable that the tube 219 is formed with a material that can prevent or reduce penetration of vapor because the ink is stored in the tube 219 temporarily. Therefore, in the present embodiment, a material including thermoplastic elastomer is used. Examples of the thermoplastic elastomer include, but not limited to, polystyrene-base thermoplastic elastomer, polyolefin-base thermoplastic elastomer, polydiene-base thermoplastic elastomer, polyvinyl chloride-base thermoplastic elastomer, polyethylene-base thermoplastic elastomer, polyurethane-base thermoplastic elastomer, polyamide-base thermoplastic elastomer, and fluorine-containing resin thermoplastic elastomer.

When the rigidity of the thermoplastic elastomer is about 50 degrees according to JIS-A standard, a sufficient degree of elasticity for pumping liquid (ink) can be available, thus reducing a pump driving load to a motor 231 for the maintenance unit 81.

When the vapor permeability of the thermoplastic elastomer is not greater than 15 $g/m^2 \cdot day$, evaporation speed of the ink in the tube 219 can be relatively slow, and thus the ink can be temporality stored in the tube 219.

As shown in FIG. 5, the maintenance unit 81 further includes a cam shaft 221 that is rotatably supported by the side plate 211 and disposed beneath the caps 82, the wiper 83, and the like. The cam shaft 221 supports a cap cam 222, a wiper cam 224, a roller 226, disposed in the dummy ejection receiver 84, that contacts ink droplets ejected in dummy ejection, a cleaner cam 228, and a carriage-lock cam 229. The cap cam 222, the wiper cam 224, the cleaner cam 228, and the carriage-lock cam 229 vertically move the cap holder 212, the wiper 83, the first wiper cleaner 86, and the carriage lock 87, respectively.

The motor 231 drives the suction pump 220 and rotates the cam shaft 221. A motor gear 232 provided on a motor shaft 231*a* engages a pump gear 233 provided on a pump shaft 220*a*. Further, an intermediate gear 234 is integrally provided on the pump gear 233, and the intermediate gear 234 engages an intermediate gear 236 via another intermediate gear 235. The intermediate gear 236 is equipped with a one-way clutch 237. Another intermediate gear 238 is provided concentrically with the intermediate gear 236, and a cam gear 240 is fixed to the cam shaft 221. The intermediate gear 238 engages the cam gear 240 via an intermediate gear 239. Thus, the rotation of the motor 231 can be transmitted to both the suction pump 220 and the cam shaft 221. The intermediate gear 236 with the clutch 237, and an intermediate shaft 241 that is a rotary shaft of the intermediate gear 238 are rotatably supported by the frame 211.

When the nozzle surface of the recording head 34 is cleaned, the motor 231 is activated to lift the wiper 83 via the wiper cam 224. By moving the carriage 33 in the main scanning direction in this state, the wiper 83 can clean the nozzle surface of the recording head 34.

If the nozzles of the recording heads 34 are kept exposed, the ink therein will dry to be thicker or even to firmly adhere to the nozzles, thus degrading the ejection performance. Therefore, the motor 231 is activated to lift the caps 82 via the cap cam 213 to seal the nozzle surfaces of the recording heads 34 with the caps 82 when image formation is not performed.

Additionally, during image formation or before and/or after image formation, dummy ejection is performed to keep sufficient level of ejection performance.

Figure 7:
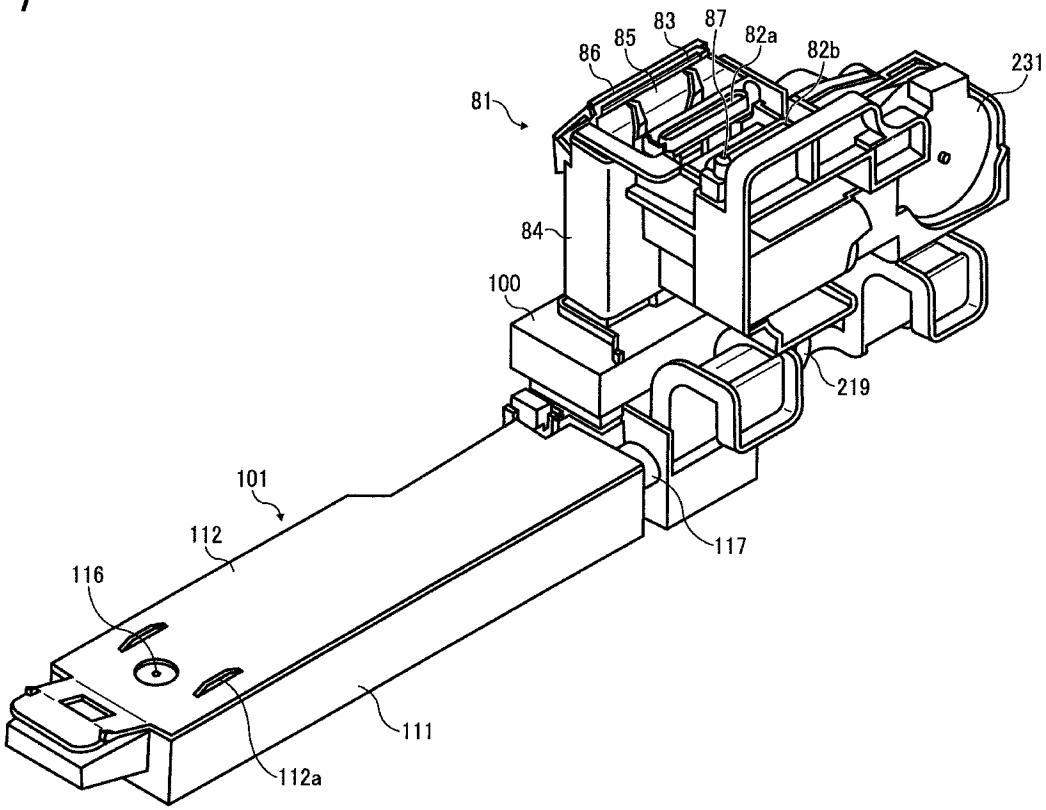
FIG. 7 is a perspective view illustrating the maintenance unit to which a second waste-ink tank is connected.
Figure 8:
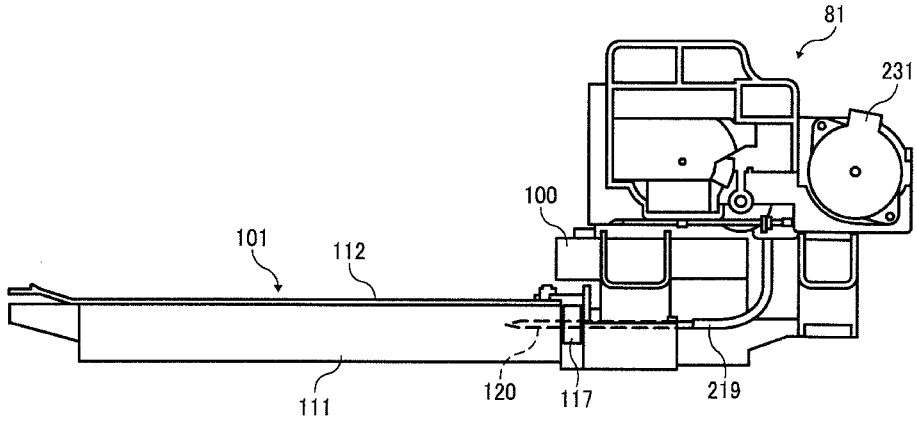
FIG. 8 is a side view illustrating the maintenance unit and the second waste-ink tank.
Figure 9:
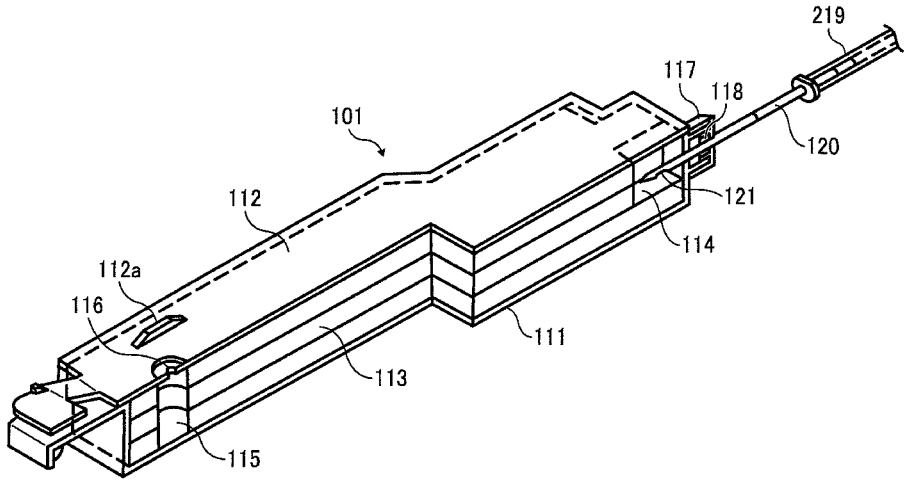
FIG. 9 is a cross-sectional perspective view illustrating an interior of the second waste-ink tank.

Referring to FIGS. 7 and 8, the maintenance unit 81 and the second waste-ink tank 101 are described in further detail below. FIG. 7 is a perspective view illustrating a state in which the second waste-ink tank 101 is connected to the maintenance unit 81, FIG. 8 is a side view illustrating that state, and FIG. 9 is a cross-sectional perspective view illustrating an interior of the second waste-ink tank 101.

As described above, the image forming apparatus 900 includes the fixed first waste-ink tank 100 that stores the waste ink received by the dummy ejection receiver 84, and the detachably attachable second waste-ink tank 101 that stores the waste ink discharged from the cap 82*a*.

The second waste-ink tank 101 is a sealed container and includes a case 111 as its main body, a lid 112, and a multi-layered absorber 113 provided in the case 111 to absorb the ink (waste ink). The absorber 113 can be formed with a nonwoven fabric, sponge, or the like and is triple-layered in the present embodiment. The case 111 can be sealed with the lid 112 through welding, via an elastic material such as a gasket, or the like. On an upper surface of the lid 112, multiple ribs 112*a* are provided to reduce or eliminate backlash of the second waste-ink tank 101 being attached to the cartridge/tank mount 4.

An inlet portion 117 is provided in an edge portion of the second waste-ink tank 101 in its longitudinal direction to which a needle 120 can be detachably attachable closely. The needle 120 serves as a connector that connects the inlet portion 117 to an end portion (hereinafter "discharge end portion") of the tube 219 from which waste ink is sent. An air hole 116 is provided on an upper surface in the other edge portion of the second waste-ink tank 101 in its longitudinal direction, where an interior of the second waste-ink tank 101 is communicated with its exterior. The air hole 116 is preferably relatively small because, if the air hole 116 is relatively large, the waste ink might spill from the second waste-ink tank 101, and simultaneously, the waste ink therein can dry easily.

In the second waste-ink tank 101, the absorber 113 is not present both in an induction space 114 corresponding to a portion where the waste ink enters the second waste-ink tank 101 and in a space 115 corresponding to the air hole 116. The space 115 penetrates all layers of the absorber 113.

In other words, the absorber 113 is disposed between the induction space 114 and the space 116, which can prevent or inhibit movement of the air therebetween, thus preventing or reducing drying of the waste ink.

Moreover, because the absorber 113 is not present in the induction space 114, insertion of the needle 120 can be relatively easy, and accordingly replacement of the second waste-ink tank 101 is relatively easy. If the absorber 113 is present in this portion, the needle 120 must pierce the absorber 113 to enter the second waste-ink tank 101, which is difficult because the absorber 113 is fine.

The space 115 can prevent or reduce bubbles of the waste ink leaking from the air hole 116, and thus the second waste-ink tank 101 can be kept clean.

As shown in FIG. 8, a solid elastic member 118 is provided in the inlet portion 118. By inserting the needle 120 that is a joint to which the tube 219 is connected to the elastic member 118, the discharge end portion of the tube 219 can be connected to the second waste-ink tank 101. The needle 120 is a hollow needle, and an opening 121 is provided on a side of its edge portion. The waste ink is sent from the tube 121 through the opening 121 to the induction space 114.

When the needle 120 is removed from the elastic member 118, the portion pierced by the needle 118 can be restored to seal the inlet portion 117. Thus, leakage of the waste ink from the inlet portion 117 can be prevented during replacement of the second waste-ink tank 101. In the replacement, the air hole 116 on the used second waste-ink tank 101 is sealed with a decal so that the waste ink does not leak therefrom.

The present embodiment further includes a waste-ink detector 91 (shown in FIG. 15) to detect whether or not the second waste-ink tank 101 is filled with the waste ink, that is, whether or not the waste ink in the second waste-ink tank 101 has increase to be greater than a predetermined or given amount. This waste-ink detector 91 can be formed with software, and the amount of the waste ink discharged therein is measured by measuring the amount of the ink discharged from the recording heads 34, which can be measured using a counter 92 (shown in FIG. 15) configured to count the number of ink droplets discharged from the recording heads 34 and with the size of the droplet. When the measured value of ink discharged to the second waste-ink tank 101 (count of the counter 92) exceeds a predetermined or given threshold value, the second waste-ink tank 101 is deemed to be filled with the waste ink. When the second waste-ink tank 101 that is deemed to be filled with the waste ink is replaced with a new one, the count is reset automatically. Alternatively, whether or not the mount of the waste ink in the second waste-ink tank 101 is greater than the predetermined amount can be detected by using a sensor 93 (shown in FIG. 15), such as an optical sensor, provided inside the second waste-ink tank 101.

Figure 10:
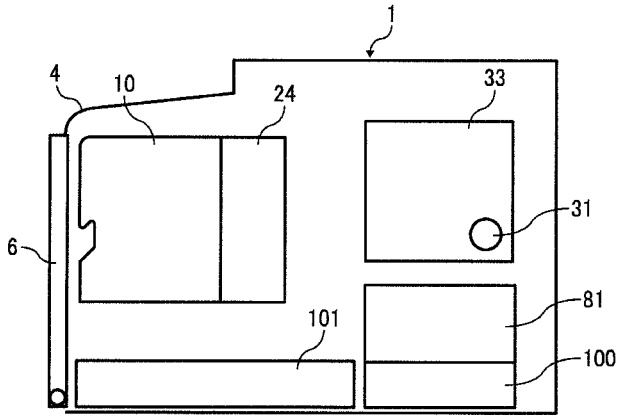
FIG. 10 is a side view illustrating a layout of the main components of the image forming apparatus.

Referring to FIG. 10, the ink cartridges 10 and the second waste-ink tank 101 are inserted in the cartridge/tank mount 4 provided on the front side of the main body 1, and the openably closable cover 6 is provided in front of the ink cartridges 10 and the second waste-ink tank 101. On the back side of the main body 1, the carriage 33 is disposed, and the maintenance unit 81 is disposed beneath the carriage 33. The first waste-ink tank 100 is disposed beneath the maintenance unit 81 in a rear portion of the main body 1, behind the second waste-ink tank 101.

The first waste-ink tank 100 stores the ink ejected onto the dummy ejection receiver 84 shown in FIG. 4 and the ink removed by the wiper 83 shown in FIG. 4 that can easily solidify, and thus the first waste-ink tank 100 is disposed beneath the maintenance unit 81 so that the waste ink from the maintenance unit 81 can directly drip to the waste-ink tank 100. The second waste-ink tank 101 stores the waste ink whose viscosity is relatively low, and thus the waste ink can be sent thereto even if the second waste-ink tank 101 is disposed close to the front side, away from the maintenance unit 81.

Figure 11:
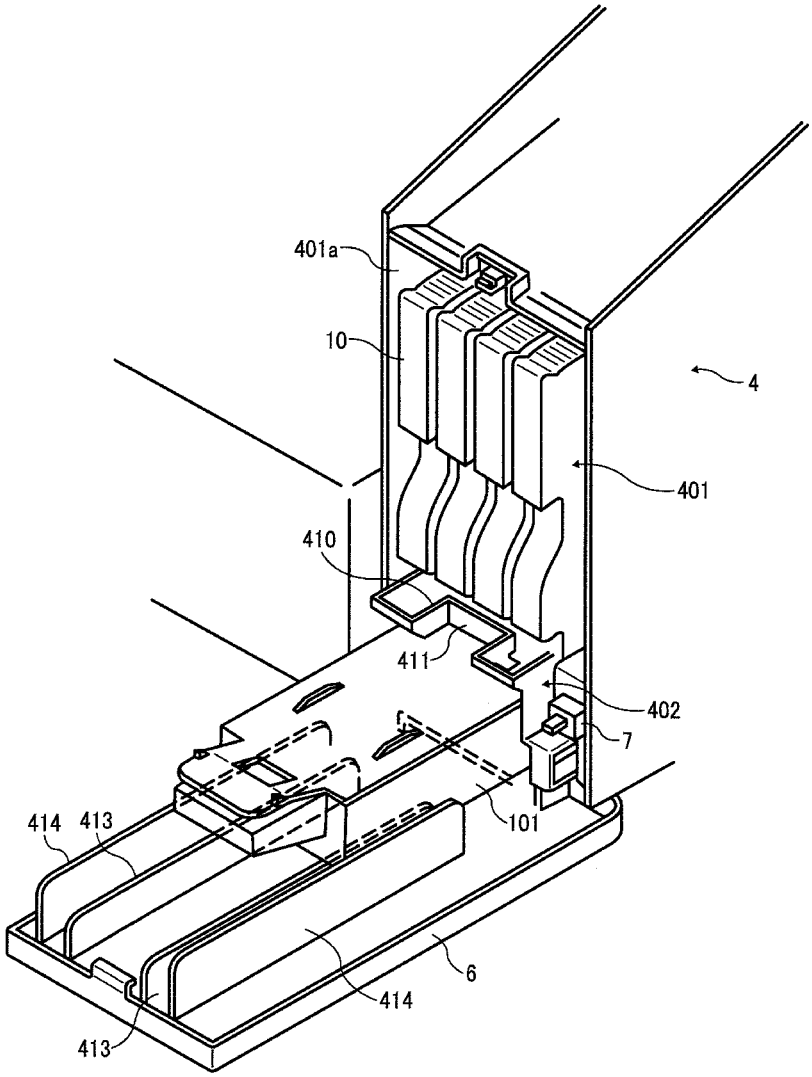
FIG. 11 is a perspective view illustrating a cartridge/tank mount according to one illustrative embodiment.
Figure 12:
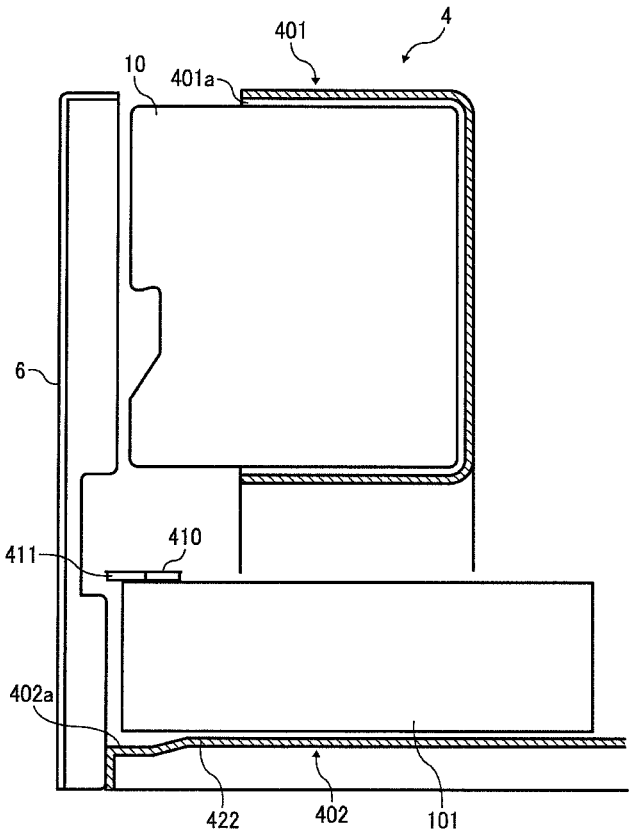
FIG. 12 is a schematic cross-sectional view illustrating the cartridge/tank mount shown in FIG. 11.
Figure 13:
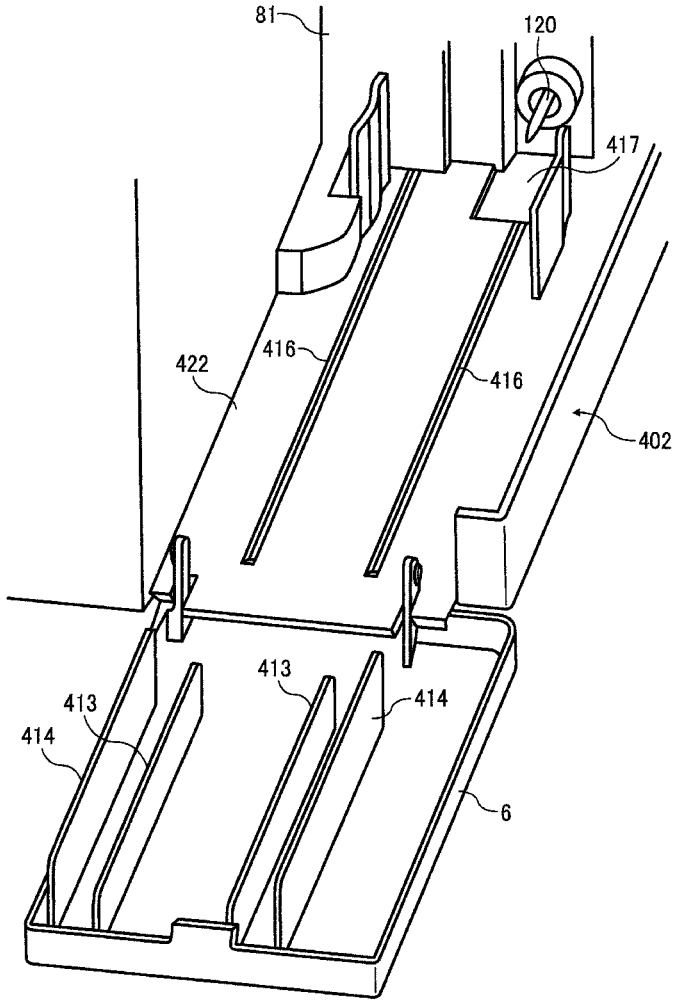
FIG. 13 is a perspective view illustrating a tank mounting portion of the cartridge/tank mount shown in FIG. 11.

The configuration of the cartridge/tank mount 4 is further described below with reference to FIGS. 11 through 13. FIG. 11 is a perspective view illustrating the cartridge/tank mount 4, FIG. 12 is a cross-sectional view thereof, and FIG. 13 is a perspective view illustrating a tank mount 402 thereof.

The cartridge/tank mount 4 includes a cartridge mount 401 including an opening 401*a* (first opening) for the ink cartridges 10 and the tank mount 402 including an opening 402*a* (second opening) for the second waste-ink tank 101. On the front side of the openings 401*a* and 402*a*, the cover 6 and a cover switch 7 are disposed. The cover switch 7 is a detector to detect open/close state of the cover 6.

When any of the ink cartridges 10 is to be replaced, the cover 6 is opened, the used cartridge 10 is removed, and then an unused ink cartridge 10 is inserted to the cartridge mount 401 from the opening 401*a*. Similarly, when the second waste-ink tank 101 is to be replaced, the cover 6 is opened, the used second waste-ink tank 101 is pulled out in the direction indicated in FIG. 2 (hereinafter "tank insertion direction"), and an unused second waste-ink tank 101 is inserted from the opening 402*a* to be attached to the tank mount 402.

In the replacement, the cover 6 is opened when any of the ink cartridges 10 and the second waste-ink tank 101 is replaced, and the cover switch 7 can detect that. Then, the controller 90 deactivates the image forming apparatus 900.

Thus, the image forming apparatus 900 can be stopped when the open state of the cover 6 is detected, and removal of any of the ink cartridges 10 and the second waste-ink tank 101 can be detected using a relatively simple mechanism.

Additionally, an upper side of a tank bracket 410 that forms the opening 402*a* of the tank mount 402 includes a concavity 411, which facilitates removal and insertion of the second waste-ink tank 101 from and to the tank mount 402.

Moreover, guide ribs 413 and 414 are provided on either side on an inner surface of the cover 6 in the tank insertion direction to guide a bottom surface of the second waste-ink tank 101. The guide ribs 413 have a height suitable to match the height of the second waste-ink tank 101 that of the opening 402. The guide ribs 414 are arranged at a distance suitable to guide the second waste-ink tank 101 according to the position of the opening 402*a* in a width direction, which is perpendicular to the tank insertion direction. Thus, the second waste-ink tank 101 can be positioned relatively easy, thus enhancing its operability.

As shown in FIG. 13, guide ribs 416 are provided on either side on a base 422, which is an inner bottom surface of the tank mount 402, in the tank insertion direction to guide the bottom surface of the second waste-ink tank 101. The guide ribs 416 have a height suitable to match the height of the inlet portion 117, to which the needle 120 is inserted, of the second waste-ink tank 101 that of the needle 120. Thus, the operability of the second waste-ink tank 101 can be further enhanced.

Additionally, an ink receiver 417 is provided beneath the needle 120 on the base 422 of the tank mount 402. Thus, when the second waste-ink tank 101 is removed from the needle 120, the ink that drips from the needle 120 can be stored in the ink receiver 417, thus preventing the ink from spreading over the bottom surface of the tank mount 402.

Figure 14:
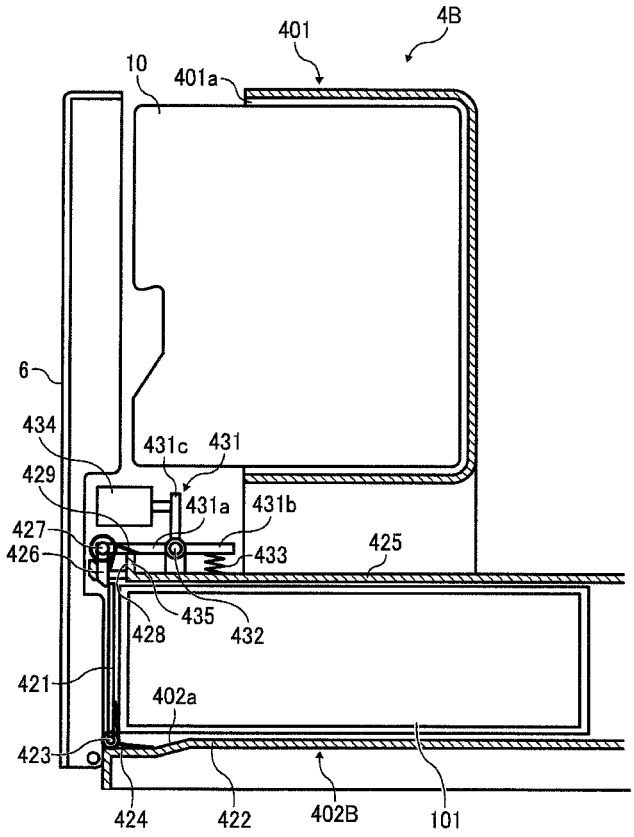
FIG. 14 a schematic cross-sectional view illustrating a cartridge/tank mount according to another illustrative embodiment.
Figure 15:
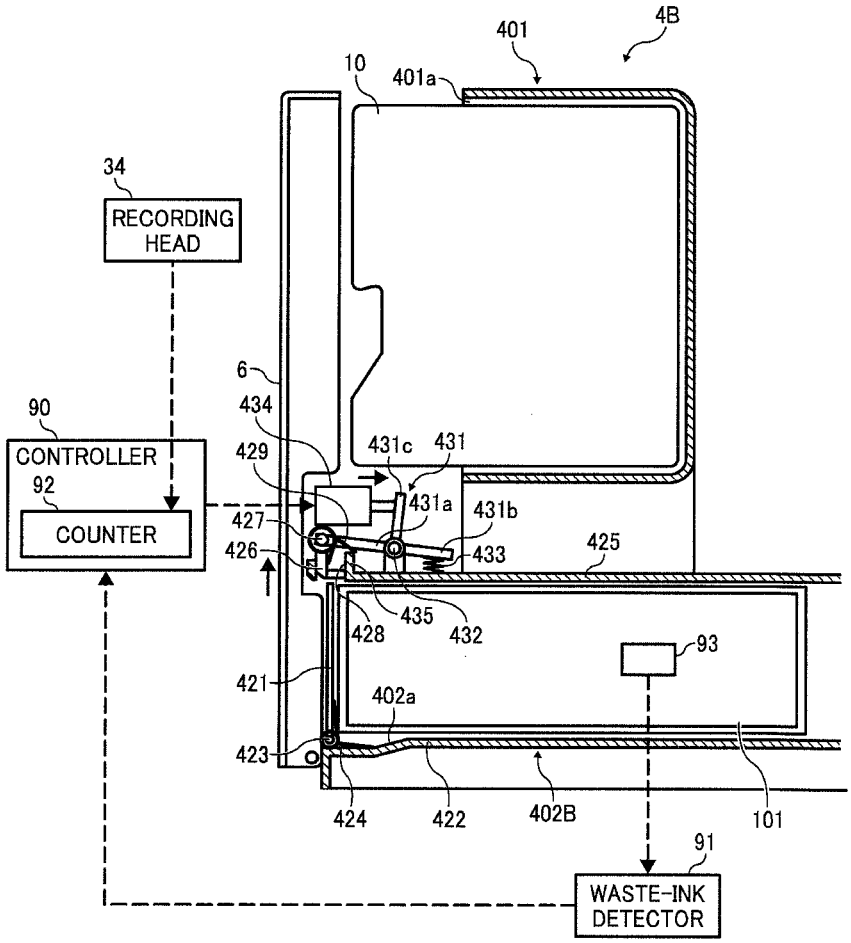
FIG. 15 is a schematic cross-sectional view illustrating the cartridge/tank mount shown in FIG. 14 when a tank cover is locked.
Figure 16:
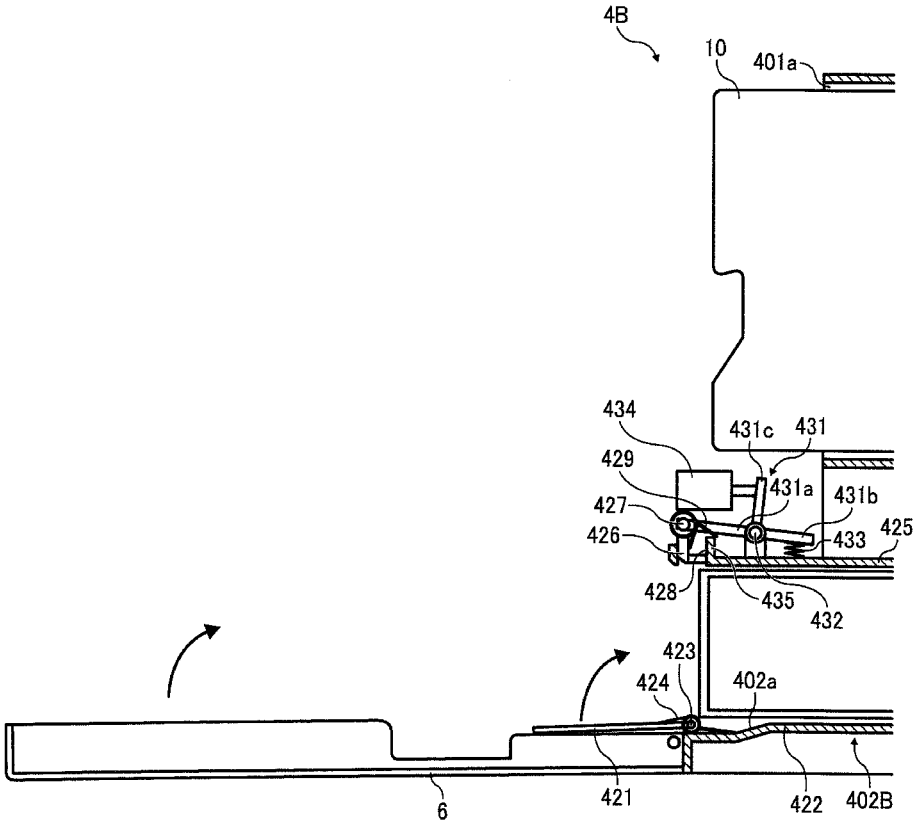
FIG. 16 is a cross-sectional view illustrating main components of the cartridge/tank mount shown in FIG. 14 when a cartridge cover is open.

A cartridge/tank holder according to another illustrative embodiment is described below with reference to FIGS. 14 through 16. FIG. 14 is a cross-sectional diagram of the cartridge/tank holder, FIG. 15 is a cross-sectional diagram of a state in which a waste-ink tank cover is unlocked, and FIG. 16 illustrates the cartridge/tank holder in which a cover for ink cartridge replacement is open.

In the present embodiment, in addition to a cover 6 for ink cartridge replacement, a cartridge/tank mount 4B includes a openably closable waste-ink tank cover 421 that is disposed between an opening 402*a* of a tank mount 402B and the cover 6. The waste-ink tank cover 421 is rotatably attached with a hinge 423 to a base 422 of the tank mount 402B, and a spring 424 urges the waste-ink tank cover 421 in a direction in which the waste-ink tank cover 421 opens with respect to the hinge 423. This direction is opposite a direction indicated by an arrow in FIG. 16.

During the replacement of the ink cartridges 10, which are replaced more frequently than a second waste-ink cartridge 101, the user might accidentally remove the second waste-ink cartridge 101. This inconvenience can be prevented in the present embodiment because the waste-ink tank cover 421 is thus provided in addition to the cover 6 for ink cartridge replacement.

Additionally, a lock pawl 426 for the waste-ink tank cover 421 is rotatably attached with a support shaft 427 to a tank bracket 425 of the tank mount 402B. The lock pawl 426 projects from an opening 428 of the tank bracket 425 to a rotatable area of the waste-ink tank cover 421, and a spring 429 urges the lock pawl 426 to the front side of the cartridge/tank mount 4B.

With this configuration, when the waste-ink tank cover 421 is closed, an edge portion of the waste-ink tank cover 421 pushes the lock pawl 426 inward and then flips to be inside the lock pawl 426. Then, the lock pawl 426 reverts to a lock position, shown in FIG. 14, to lock the closed waste-ink tank cover 421.

The tank mount 402B further includes a release layer 431 to release lock of the waste-ink tank cover 421 by the lock pawl 426. The release layer 431 is pivotally attached on the tank bracket 425 with a support shaft 423 and includes arms 431*a*, 431*b*, and 431*c* that are at a right or substantially right angle with each other. The support shaft 427 of the lock pawl 426 is attached to the arm 431*a*, and a spring 433 is provided between the arm 431*b* and the tank bracket 425. The spring 433 urges the release lever 431 in a direction in which the arm 431*a* descends. Further, disposed facing the arm 431*c* is a solenoid 434 that rotates the release layer 431 in a direction in which the arm 431*a* ascends. A stopper 435 that restricts a lower portion of the arm 431*a* is provided on the tank bracket 425.

With this configuration, referring to FIG. 15, when the waste-ink detector 91 that detects that the waste ink in the second waste-ink tank 101 has increased to be greater than the predetermined amount based on either the count by the counter 92 or a detection result generated by the sensor 93, the controller 90 drives the solenoid 434 to push the release lever 431 in a direction indicated by an arrow shown in FIG. 15. Then, the release lever 431 rotates in the direction in which the arm 431*a* ascends to cause the lock pawl 426 to ascend in a direction indicated by an arrow shown in FIG. 15, thus unlocking the waste-ink tank cover 421. Then, the waste-ink tank cover 421 is opened by the bias force of the spring 424 toward the cover 6 for ink cartridge replacement, and then the cover 6 opens together with the waste-ink tank cover 421 as shown in FIG. 16.

Moreover, as the waste-ink tank cover 421 is urged by the spring 424 to the side of the cover 6, the waste-ink tank cover 421 can open in conjunction with the cover 6, as shown in FIG. 16, when the cover 6 is opened. Similarly, when the cover 6 is lifted to close in the direction indicated by the arrow shown in FIG. 16, the waste-ink tank cover 421 can be closed in conjunction with the cover 6.

Thus, even when the waste-ink tank cover 421 is provided inside the cover 6, it is not necessary to open the cover 6 and the waste-ink tank cover 421 separately, simplifying the operation of the user, which can enhance the operability.

Next, a cartridge/tank holder according to another illustrative embodiment is described below with reference to FIG. 17 that is a plan view of a tank mount 402C according to another illustrative embodiment.

In the present embodiment, a projection 441 is provided on an upper surface of a second waste-ink tank 101A, and a stopper 442 is rotatably attached to a tank bracket 425 with a support shaft 443. The stopper 442 includes an arm 442*a* that can engage the projection 441 of the tank mount 402C and an arm 442*b* that can restrict rotation of a lock pawl 426 for a waste-ink tank cover 421. The stopper 442 is urged to a position indicated by broken lines shown in FIG. 17 by a bias member, such as a spring, not shown, and thus restricts the inward rotation of the lock pawl 426. That is, the stopper 442 can set the position of the lock pawl 426.

Figure 17:
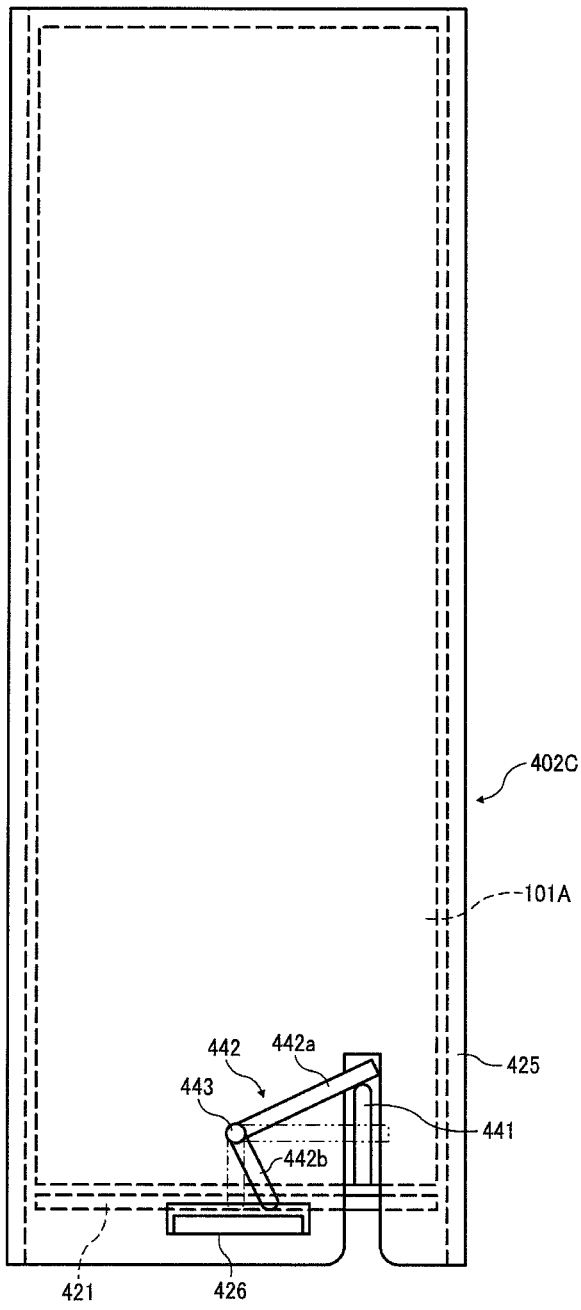
FIG. 17 is a plan view illustrating a tank mounting portion according to another illustrative embodiment.

With this configuration, when the second waste-ink tank 101A is inserted into the tank mount 402C, the arm 442*a* of the stopper 442 rotates to a portion indicated by a solid line in FIG. 17, pushed by the projection 441, and thus the arm 442*b* is out of the rotatable area of the lock pawl 426. Therefore, the waste-ink tank cover 421 can be closed while the waste-ink tank cover 421 pushes the lock pawl inward.

By contrast, when the second waste-ink tank 101A is not attached to the tank mount 402C, the stopper 442 is not pushed inward to release the lock pawl 426. Because the lock pawl 426 is fixed by the stopper 442, the lock pawl 426 cannot be pushed even if the user tries to close the waste-ink tank cover 421. Thus, the waste-ink tank cover 421 remains open. Thus, the lock pawl 426 and the stopper 442 together form a tank cover preventer that prevents the waste-ink tank cover 421 from being closed.

Figure 18:
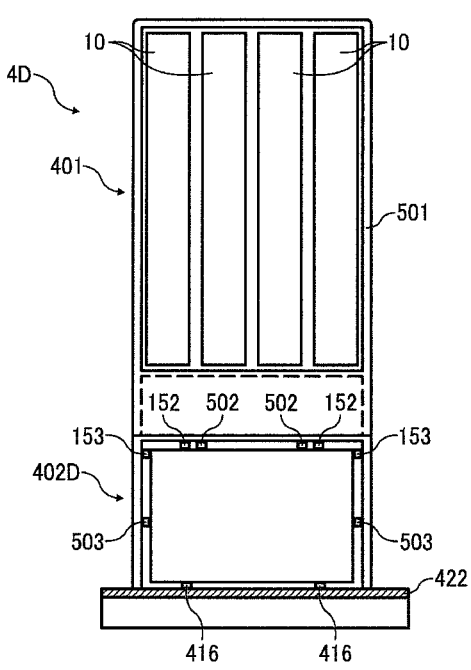
FIG. 18 is a front elevation view illustrating a cartridge/tank mount according to another illustrative embodiment.
Figure 19:
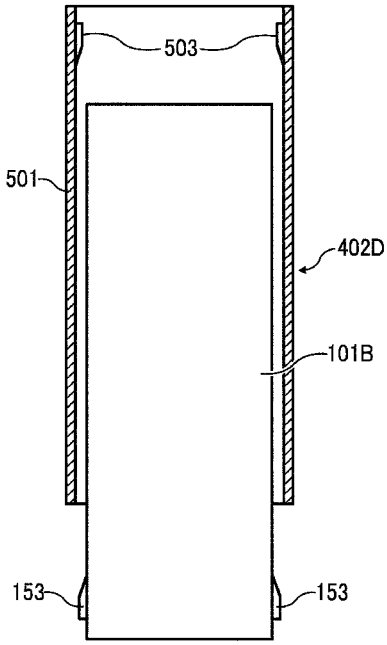
FIG. 19 is a plan view of a tank mounting portion of the cartridge/tank mount shown in FIG. 18.

A cartridge/tank holder according to yet another illustrative embodiment is described below with reference to FIGS. 18 and 19 that are respectively an front elevation view of a cartridge/tank mount 4D and a plan view of a tank mount 402D according to another illustrative embodiment.

In the present embodiment, a tank bracket of a second waste-ink tank 101B is integrated into an ink supply unit frame 501 that forms a frame of the entire cartridge/tank mount 4D. The position of the second waste-ink tank 101B in a vertical direction is determined by ribs 502 provided on the ink supply unit frame 501 as well as ribs 152 provided on an upper surface of the and second waste-ink tank 101B, and that in a horizontal direction is determined by ribs 503 provided on inner side surfaces of the ink supply unit frame 501 as well as ribs 153 provided on side surfaces of the and second waste-ink tank 101B.

Thus, the second waste-ink tank 101B can be positioned by a relatively simple configuration.

As can be appreciated by those skilled in the art, although the description above concerns the liquid-ejecting printers, the present invention is applicable to facsimile machines, copies, multifunction machines capable of at least two of printing, fax transmitting, and copying, or apparatuses, such as those used in a medical field, that form images by ejecting liquid, such as DNA samples, other than ink.

Numerous additional modifications and variations are possible in light of the above teachings. It is therefore to be understood that, within the scope of the appended claims, the disclosure of this patent specification may be practiced otherwise than as specifically described herein.

What is claimed is:

1. An image forming apparatus, comprising:

a recording head configured to eject ink droplets through a nozzle onto a recording medium;

a plurality of replaceable ink cartridges configured to contain plural respective inks to be supplied to the recording head;

a single replaceable waste-ink tank configured to store plural different color waste inks from the plural inks ejected or suctioned from the recording head;

a cartridge mounting portion provided on a front side of the image forming apparatus, and configured to accommodate the ink cartridges, the cartridge mounting portion including a first opening through which any one or more of the plurality of ink cartridges is inserted from the front side of the image forming apparatus;

a tank mounting portion provided adjacent to the cartridge mounting portion, on the front side of the image forming apparatus, and configured to accommodate the single replaceable waste-ink tank, the tank mounting portion including a second opening through which the single waste-ink tank is inserted from the front side of the image forming apparatus;

a bracket plate to separate the cartridge mounting portion from the tank mounting portion in a vertical direction with a gap, the cartridge mounting portion housing the plurality of ink cartridges being above the bracket plate; and an openably closable cartridge cover disposed on the front side of the image forming apparatus, and configured to cover both the first opening and the second opening and to cover all of the single waste-ink tank and plurality of ink cartridges;

wherein the cartridge mounting portion and the tank mounting portion are positioned on the front side of the image forming apparatus and are arranged vertically adjacent to each other, the plurality of ink cartridges arc mounted above the single waste-ink tank, and in a state in which the single waste-ink tank is mounted in the tank mounting portion and the plurality of ink cartridges are mounted in the cartridge mounting portion, the single waste-ink tank is separated from the plurality of ink cartridges by the gap in the vertical direction.

2. The image forming apparatus according to claim 1, wherein the cartridge mounting portion and the tank mounting portion are respectively disposed within recessed portions of a cartridge/tank mount formed on the front side of the image forming apparatus.

3. The image forming apparatus according to claim 1, further comprising an openably closable tank cover disposed between the cartridge cover and the second opening of the tank mounting portion to cover the second opening, wherein the tank cover is provided between the cartridge cover and the single waste-ink tank upon mounting of the single waste-ink tank in the tank mounting portion.

4. The image forming apparatus according to claim 3, further comprising a tank cover lock to lock the tank cover.

5. The image forming apparatus according to claim 4, further comprising a waste-ink detector to detect whether or not the waste ink in the waste-ink tank is greater than a predetermined amount, wherein the tank cover lock is unlocked when the waste-ink detector detects that the waste ink in the waste-ink tank is greater than the predetermined amount.

6. The image forming apparatus according to claim 5, wherein the waste-ink detector comprises a counter to count a number of ink droplets ejected by the recording head, and the waste-ink detector detects whether or not the waste ink in the waste-ink tank is greater than the predetermined amount based on a count of the counter.

7. The image forming apparatus according to claim 5, wherein the waste-ink tank comprises a sensor to detect the waste ink therein, and the waste-ink detector detects whether or not the waste ink in the waste-ink tank is greater than the predetermined amount based on a detection result generated by the sensor.

8. The image forming apparatus according to claim 3, wherein the tank mounting portion further comprises a tank cover preventer to prevent the tank cover from being closed when the waste-ink tank is not attached to the tank mounting portion.

9. The image forming apparatus according to claim 8, wherein the tank cover preventer comprises:

a pivotable tank cover lock that pivots inward when pushed by the tank cover and then reverts to a lock position to lock the tank cover in place; and a pivotable stopper to set the tank cover lock to the lock position to lock the tank cover when the waste-ink tank is not attached to the tank mounting portion.

10. The image forming apparatus according to claim 3, wherein the tank cover is openable in conjunction with opening of the cartridge cover and closeable in conjunction with closing of the cartridge cover.

11. The image forming apparatus according to claim 1, further comprising an ink receiver provided on a bottom surface of the tank mounting portion to store the waste ink.

12. The image forming apparatus according to claim 1, wherein he cartridge cover comprises a guide to guide the waste-ink tank when the cartridge cover is open.

13. The image forming apparatus according to claim 1, further comprising a non-replaceable waste-ink tank configured to store the waste ink, wherein the non-replaceable waste-ink tank is disposed in a rear portion of the image forming apparatus behind the replaceable waste-ink tank.

14. The image forming apparatus according to claim 13, further comprising:

a carriage disposed in the rear portion of the image forming apparatus, on which the recording head is mounted; and a maintenance unit disposed beneath the carriage, configured to clean the recording head, wherein the non-replaceable waste-ink tank is disposed beneath the maintenance unit.

15. The image forming apparatus according to claim 1, wherein the bracket portion includes a concavity defining the second opening of the tank mounting portion.

16. The image forming apparatus according to claim 1, wherein the tank mounting portion is configured for removal of the single waste-ink tank therefrom, independent of removal of any ink cartridge, in a direction toward the front side of the image forming apparatus.

17. An image forming apparatus, comprising:

a recording head configured to eject ink droplets through a nozzle onto a recording medium;

a replaceable ink cartridge configured to contain ink to be supplied to the recording head;

a single replaceable waste-ink tank configured to store waste ink ejected or suctioned from the recording head;

a cartridge mounting portion provided on a front side of the image forming apparatus, and configured to accommodate the ink cartridge, the cartridge mounting portion including a first opening through which the ink cartridge is inserted from the front side of the image forming apparatus;

a tank mounting portion provided adjacent to the cartridge mounting portion, on the front side of the image forming apparatus, and configured to accommodate the single replaceable waste-ink tank, the tank mounting portion including a second opening through which the single waste-ink tank is inserted from the front side of the image forming apparatus, and the tank mounting portion being below the cartridge mounting portion;

a bracket plate to separate the cartridge mounting portion from the tank mounting portion in a vertical direction with a gap, the cartridge mounting portion housing the ink cartridge being above the bracket plate; and an openably closable cartridge cover disposed on the front side of the image forming apparatus, and configured to cover both the first opening and the second opening;

wherein the cartridge mounting portion and the tank mounting portion are positioned on the front side of the image forming apparatus and are arranged vertically adjacent to each other, the ink cartridge is mounted above the single waste-ink tank, and in a state in which the single waste-ink tank is mounted in the tank mounting portion and the ink cartridge is mounted in the cartridge mounting portion, the single waste-ink tank is separated from the ink cartridge by the gap in the vertical direction.

18. The image forming apparatus according to claim 1, wherein the single waste-ink tank mounted directly underneath the plurality of ink cartridges has a length in a feeding direction of the recording medium which is greater than a length of the plurality of ink cartridges in the feeding direction of the recording medium.

19. The image forming apparatus according to claim 1, wherein a front surface of the single waste-ink tank facing the front side of the image forming apparatus and front surfaces of the plurality of ink cartridges facing the front side of the image forming apparatus are on a substantially same plane perpendicular to a feeding direction of the recording medium.

* * * * *